US007434572B2

(12) United States Patent
Hütter et al.

(10) Patent No.: US 7,434,572 B2
(45) Date of Patent: Oct. 14, 2008

(54) CYLINDER HEAD OF AN INTERNAL COMBUSTION ENGINE

(75) Inventors: Ulrich Hütter, Stuttgart (DE); Torsten Schellhase, Vaihingen/Enz (DE)

(73) Assignee: MAHLE International GmbH, Stuttgart (DE)

( * ) Notice: Subject to any disclaimer, the term of this patent is extended or adjusted under 35 U.S.C. 154(b) by 48 days.

(21) Appl. No.: 11/716,330

(22) Filed: Mar. 9, 2007

(65) Prior Publication Data

US 2007/0215075 A1 Sep. 20, 2007

(30) Foreign Application Priority Data

Mar. 20, 2006 (DE) ..... 10 2006 012 611

(51) Int. Cl.

| | |
|---|---|
| ***F01M 13/00*** | (2006.01) |
| ***F01M 9/10*** | (2006.01) |
| ***F01M 3/04*** | (2006.01) |
| ***F02F 1/42*** | (2006.01) |

(52) U.S. Cl. ..... 123/572; 123/41.86; 123/90.38; 123/196 M; 123/193.5

(58) Field of Classification Search ..... 123/41.86, 123/90.38, 90.34, 196 M, 193.5, 572, 573, 123/574

See application file for complete search history.

(56) References Cited

U.S. PATENT DOCUMENTS

| | | | | |
|---|---|---|---|---|
| 4,651,704 | A | 3/1987 | Sekiguchi | |
| 5,027,784 | A | 7/1991 | Osawa et al. | |
| 6,854,454 | B2 * | 2/2005 | Obayashi et al. | 123/572 |
| 7,117,858 | B2 * | 10/2006 | Nonaka et al. | 123/572 |
| 7,219,629 | B2 * | 5/2007 | Miyake et al. | 123/25 A |

FOREIGN PATENT DOCUMENTS

| | | |
|---|---|---|
| DE | 199 31 740 A1 | 1/2001 |
| DE | 102 26 695 A1 | 12/2003 |
| FR | 2 868 468 | 10/2005 |
| JP | 1 122443 | 5/1989 |
| JP | 1 148009 | 10/1989 |
| JP | 7 150923 | 6/1995 |
| JP | 8 284634 | 10/1996 |

* cited by examiner

*Primary Examiner*—Stephen K. Cronin
*Assistant Examiner*—Hyder Ali
(74) *Attorney, Agent, or Firm*—Collard & Roe, P.C.

(57) ABSTRACT

The invention relates to a cylinder head (1) of an internal combustion engine with a camshaft bearing mechanism (2) situated thereon in which a hollow camshaft (3) is rotatably mounted, forming an outlet for discharging blow-by gases laden with oil droplets out of the crankcase and is designed as an oil droplet separator for separating the oil content out of these gases. The camshaft (3) passes through a valve space (11). A rocker cover (13) or a multichannel device (27) is connected axially to at least one end of the camshaft (3), forming an axial gap (9), each having a channel (10) connected coaxially to the hollow space (5) of the camshaft (3) so that blow-by gases from which the oil has been removed can be discharged from the camshaft (3), and each being designed so that they either form an oil collecting space (12) that is sealed with respect to the valve space (11) or they introduce oil that has been separated into such an oil collecting space (12).

10 Claims, 4 Drawing Sheets

CYLINDER HEAD OF AN INTERNAL COMBUSTION ENGINE

CROSS REFERENCE TO RELATED APPLICATIONS

Figure 1:
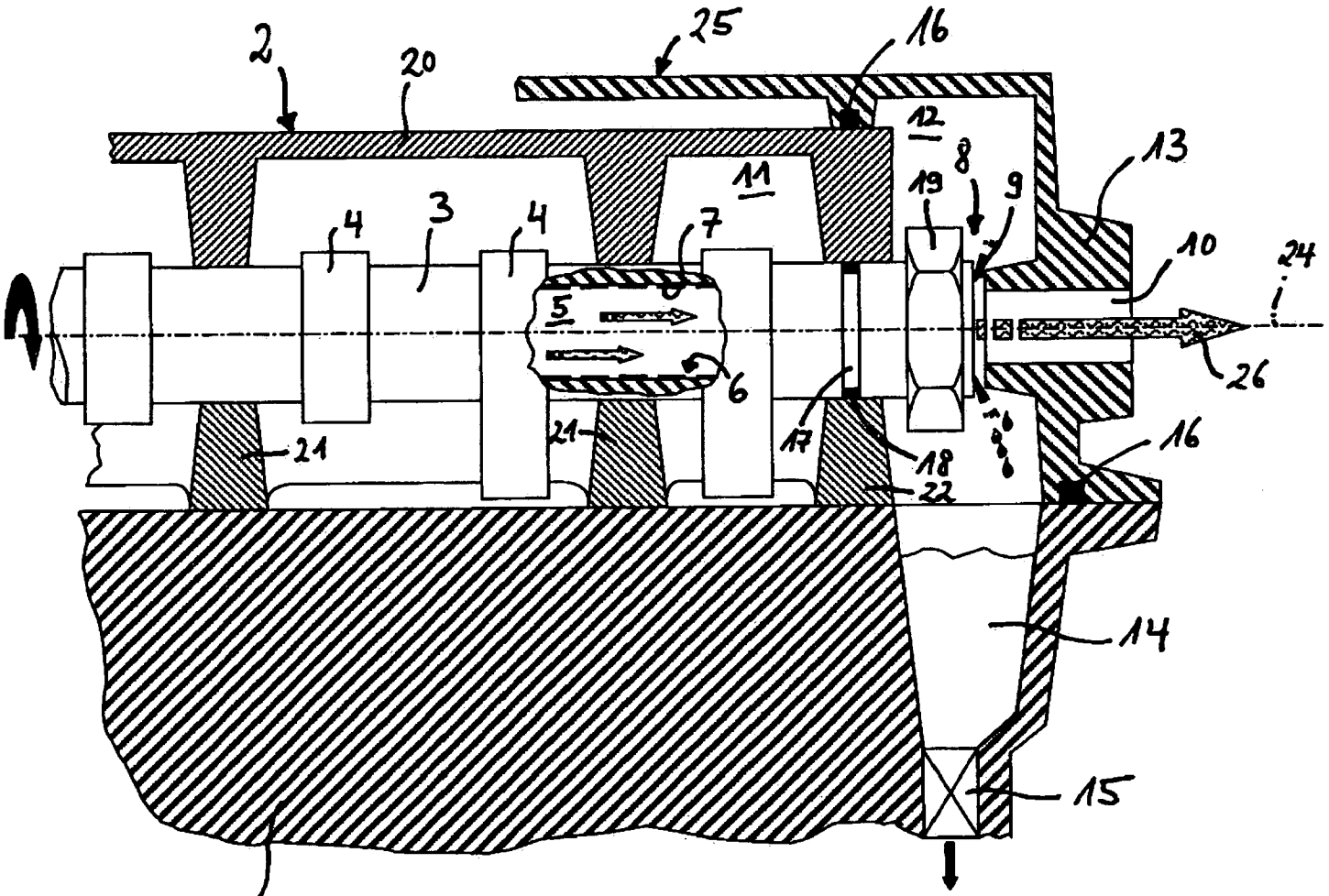

Applicant claims priority under 35 U.S.C. §119 of German Application No. 10 2006 012 611.4 filed Mar. 20, 2006.

The invention relates to a cylinder head of an internal combustion engine having a camshaft bearing mechanism arranged on the cylinder head.

With known combustion engines, so-called blow-by gases containing oil droplets are drawn into a hollow camshaft in the crankcase and centrifuged there, resulting in deposition of the oil dissolved in the blow-by gases on the inside wall of the camshaft. The oil droplets thereby deposited on the inside wall of the camshaft form an oil film which is conveyed to an outlet based on the gas flow prevailing in the camshaft. One disadvantage of the known systems is that they have so far required complex and therefore expensive designs in the area where the oil and gas components must be removed separately from one another in emerging from the camshaft.

The present invention therefore relates to the problem of improving upon a generic cylinder head of an internal combustion engine, i.e., an engine with a camshaft designed as an oil droplet separator, in comparison with the state of the art known in the past, such that it can be manufactured more easily on the whole and therefore less expensively.

This problem is solved by a cylinder head having all the features of Patent claim 1.

Advantageous and expedient embodiments are the subject of the subclaims.

The invention is based on the general idea of forming and/or limiting an oil collection space that has previously had a complex design composed of numerous individual parts along with the channel leading out of this oil collection space for the gas from which the oil has been removed, so that it now has a structurally simple design due to a specially designed rocker cover accordingly and/or a multichannel mechanism such that the oil collection space is sealed with respect to the valve space on the one hand, while on the other hand the gas discharge channel is either integrated directly into the rocker cover or runs inside the latter. The cylinder head has a camshaft bearing mechanism arranged thereon in which there is a rotatably mounted hollow camshaft that forms a vent for blow-by gases containing oil and is thus designed as an oil droplet separator, in particular a centrifugal oil droplet separator. The camshaft passes axially through a valve space which contains the bearing mechanism and in which the individual cams of the camshaft are arranged. The rocker cover or the multichannel device, each having an essentially coaxially connected channel on the hollow space of the camshaft, is arranged on at least one axial e n d area of the camshaft, forming an axial gap so that the blow-by gases from which the oil droplets have been removed can be vented from the camshaft through this coaxial channel due to the reduced pressure.

As mentioned above, the rocker cover or the multichannel device is designed so that it at least partially surrounds the oil separation space, which is separated from the valve space of the internal combustion engine. This offers the great advantage that the rocker cover or the multichannel device now serves to form the oil separation space, so that separate components that were previously required for bordering the oil separation space can now be omitted so that the multiplicity of parts can be reduced and therefore the internal combustion engine and/or the cylinder head can be manufactured more easily and less expensively on the whole. The gas vent channel (cleaned blow-by gas) can be molded directly in the rocker cover or can at least run inside the rocker cover.

According to a preferred embodiment of the inventive approach, the rocker cover is in sealing contact with the cylinder head on the one end and with the camshaft or the camshaft bearing mechanism on the other hand. On the basis of this approach, it is already clearly discernible that it is possible to use different rocker covers which are adapted to the particular type of internal combustion engine and take into account the particular design characteristics while having in common the fact that they separate the oil separation space from the valve space with a seal. The design of the rocker cover may also be based on possible maintenance work to be performed, so it is conceivable for the rocker cover to be designed to allow particularly easy access to the valve space and/or the oil separation space when the rocker cover is removed, so that ease of maintenance is increased and maintenance costs can be reduced.

The rocker cover is expediently made of plastic and may have a metallic insert in the area of the seals. Manufacturing the rocker cover of plastic allows virtually any shaping with a high design freedom at the same time and can also be implemented inexpensively. A rocker cover made of plastic also has a noise suppression effect, which has an especially favorable effect on the noise emission by the internal combustion engine. The metallic insert provided in the area of the seal ensures a reliable and therefore tight contact for the seal on the one hand while on the other hand increasing the lifetime of the rocker cover because it is designed to be wear resistant in the area of seals due to the metallic insert.

Advantageous exemplary embodiments that are explained in greater detail below are depicted schematically in each of the drawings.

Figure 2:
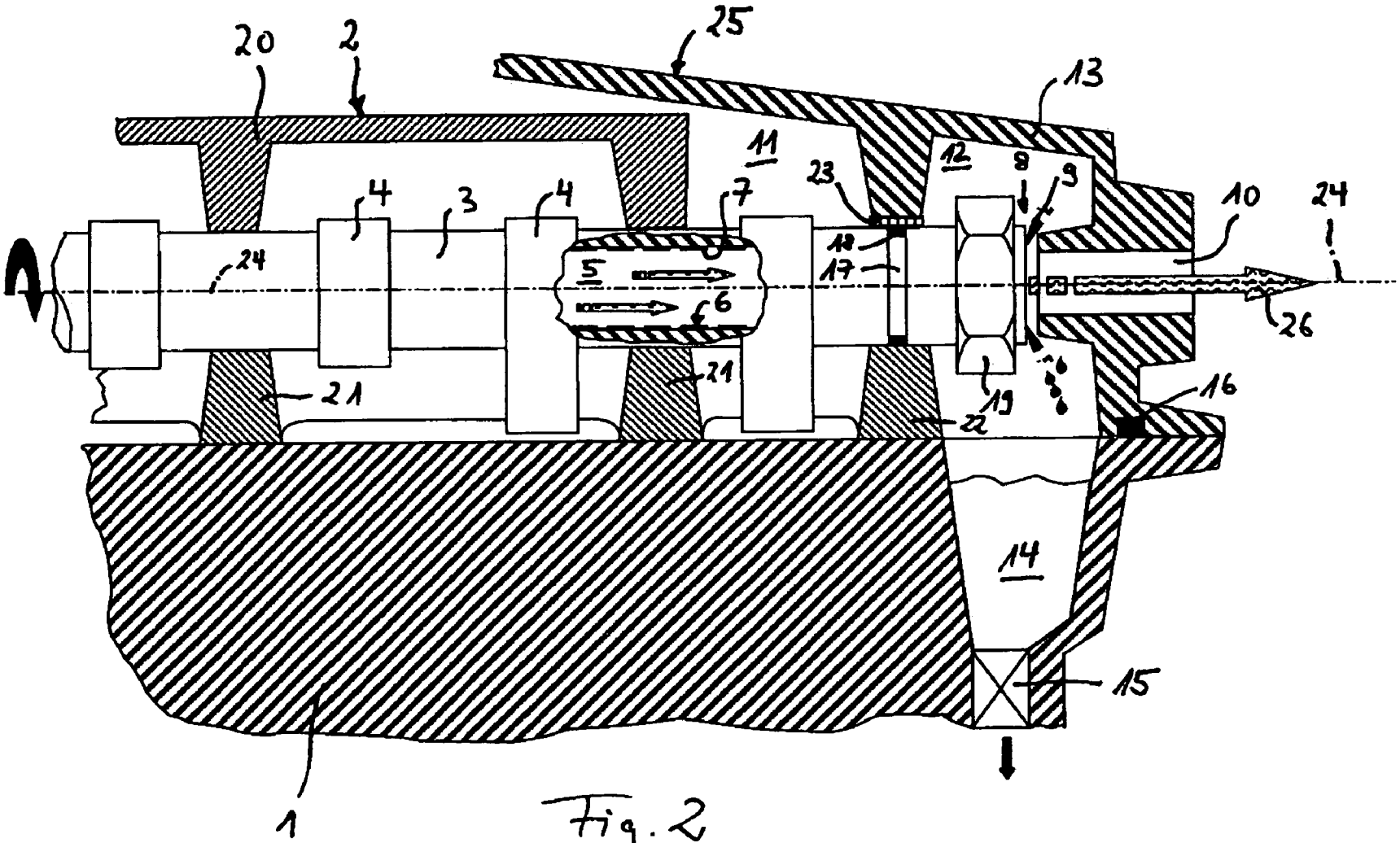
Figure 3:
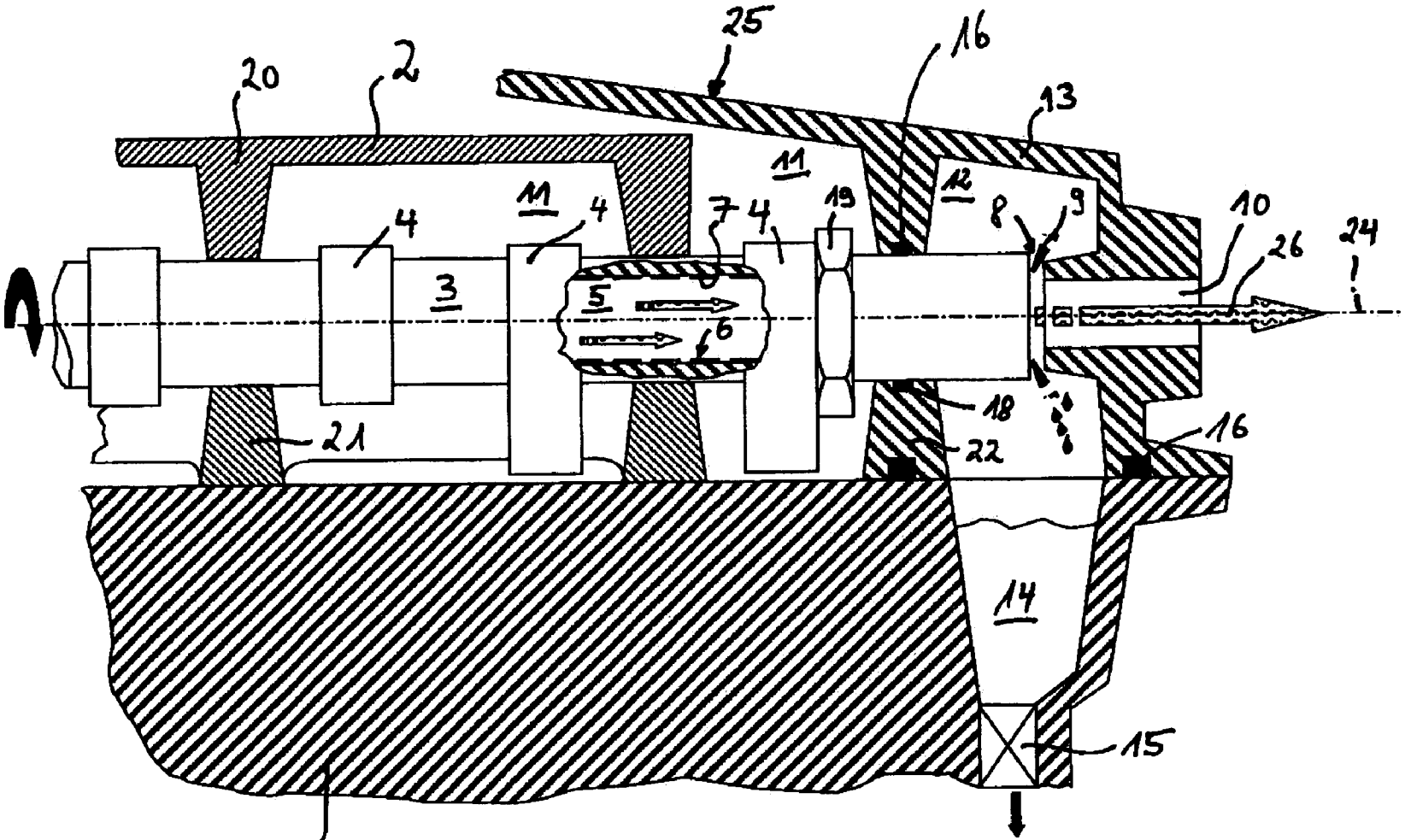
Figure 4:
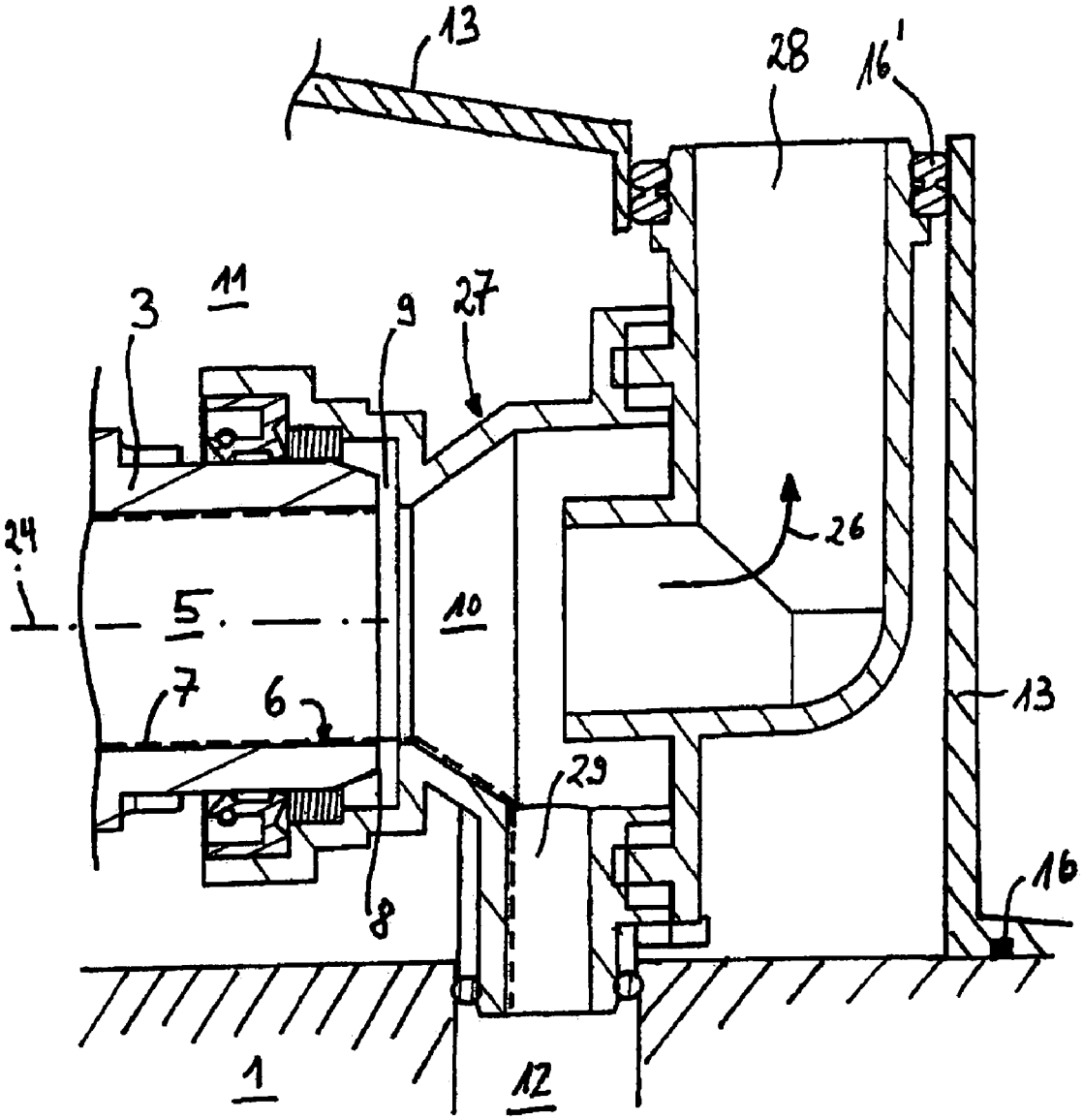

The drawings show in schematic diagrams:

FIG. 1 a longitudinal section through a cylinder head in the area of an axial end area of a camshaft, FIG. 2 a diagram like that in FIG. 1 but with another embodiment of a rocker cover, FIG. 3 a diagram like that in FIG. 2 but with another camshaft and another rocker cover, FIG. 4 a detailed view of an axial camshaft end with a multichannel device.

According to FIG. 1, a cylinder head 1, a portion of which is shown, for an internal combustion engine (not otherwise shown) has a camshaft bearing mechanism 2 and a hollow camshaft 3 rotatably mounted therein. The chamshaft 3 has several cams 4 with which valves (not shown) of the internal combustion engine are controlled. The hollow design of the camshaft 3 allows conveyance of blow-by gases containing oil in the cavity 5 therein, thereby allowing the crankcase to be vented. The hollow camshaft 3 is designed as an oil droplet separator, in particular as a centrifugal oil droplet separator, and induces centrifugal acceleration of the blow-by gases conveyed in the hollow space 5 due to the rotational movement of the camshaft 3 during operation of the internal combustion engine. Oil droplets dissolved in the form of an aerosol in the blow-by gases are then accelerated radially outward, being deposited in the form of an oil film 7 on an inside wall 6 of the hollow space 5. According to FIG. 1, the oil film 7 is conveyed in the direction of an axial end 8 of the camshaft 3 because of the flow of blow-by gases in the hollow space 5 of the camshaft 3, a rocker cover 13 being connected to this axial end, forming an axial gap 9, with a channel 10 being connected coaxially to the hollow space 5 of the camshaft 3 so that blow-by gases from which the oil droplets have been removed can be discharged from the camshaft 3 through this channel. The blow-by gases are preferably conveyed in the hollow space 5 and/or in the channel 10 by creating a reduced pressure.

As shown in FIG. 1, the camshaft 3 passes through a valve space 11 containing the cam shaft bearing mechanism 2 and protrudes axially out of the valve space at one end. The axial end area 8 of the camshaft 3 which is not arranged in the valve space 11 protrudes into an oil separation space 12 which is bordered essentially by the cylinder head 1 on one end and by the rocker cover 13 on the other end. The rocker cover 13 is designed so that it seals the oil separation space 12 with respect to the valve space 11 and thus forms a space that is sealed off from the valve space 11.

After reaching the axial gap 9, the oil film 7 deposited on the inside wall 6 of the hollow space 5 escapes into the oil separation space 12 due to its radial acceleration and is collected there. Since the oil separation space 12 is closed with respect to the valve space 11, the same reduced pressure prevails there as in the hollow space 5, so the oil film 7 is not prevented from flowing out of the axial gap 9.

According to FIGS. 1 through 3, the oil separation space 12 has an oil sump 14 situated in the cylinder head 1 in which the oil escaping from the axial gap 9 is initially collected. For draining out or recirculating the oil collected in the oil sump 14, it may have a drain valve and/or a drain barrier 15, which is opened as needed.

As also shown in FIG. 1, the rocker cover 13 is in sealing contact with the cylinder head 1 at one end and with the camshaft bearing mechanism 2 at the other end, whereby sealing elements 16 are arranged in the respective contact faces. To seal the oil separation space 12 with respect to the valve space 11, a ring groove 17 is provided on the camshaft 3 according to FIG. 1, with a ring gasket 18, e.g., a piston ring, preferably being arranged in this ring groove. In general, the present invention should include both grinding and nongrinding seals here.

For aligning the camshaft 3, it has an adjustment mechanism 19, namely a hexagon head here, situated in the oil separation space 12 according to FIG. 1, but in this embodiment as well as in other embodiments (see FIG. 3) it may also be situated in the valve space 11. The adjustment mechanism 19 according to FIG. 3 is not only in the valve space 11 but is also brought against the last cam 4 of the camshaft 3 and may be connected directly to it, for example. On the whole, the rocker cover 13 according to FIG. 1 covers not only the oil separation space 12 but also the valve space 11 and the camshaft bearing mechanism 2.

In addition, the camshaft bearing mechanism 2 is designed in at least two parts and has at least one upper section 20 and lower bearing 21. The bearings 21 may be connected fixedly or in one piece to the cylinder head 1 or connected in one piece to a separate part, namely a lower camshaft bearing mechanism. The upper section 20 of the camshaft bearing mechanism 2 is designed to be removable so that simple access to the camshaft 3 is ensured. A bulkhead wall 22 is provided between the valve space 11 and the oil collecting space 12. In the area situated beneath the camshaft 3, a lower part of the bulkhead wall 22 separates the oil separation space 12 from the valve space 11, which according to this invention should not usually have any bearing function in support of the camshaft 3. Instead, a radial gap (not shown in FIG. 1) is usually provided here between the bulkhead wall 22 and the camshaft 3; such a radial gap usually prevents direct contact between the bulkhead wall 22 and the camshaft 3. However, there is at least contact via the ring gasket 18 which is in turn in contact with the camshaft 3 and the bulkhead wall 22.

FIG. 2 shows another embodiment of the rocker 13 in comparison with that in FIG. 1, whereby the rocker cover here has a metallic insert 23 in the area of the ring gasket 18 to increase the lifetime of the rocker cover 13 while also allowing an improved sealing function of the ring gasket 18. Since all the rocker covers 13 according to FIGS. 1 through 3 are preferably made of plastic, such metallic inserts 23 increase in particular the wear resistance at the transition from the rocker cover 13 to the ring gasket 18 and/or the camshaft 3.

In contrast with FIG. 1, the rocker covers 13 according to FIG. 2 and 3 have a different design, each having a top side 25 that is inclined toward the axis 24 of the camshaft 3. However, the function principle, namely the separation of the valve space 11 from the oil separation space 12, is also accomplished with the rocker covers 13 according to FIGS. 2 and 3.

In contrast with FIG. 2, the rocker cover 13 shown in FIG. 3 also includes the lower bulkhead wall 22, so the bulkhead wall 22 is preferably an integral component of the rocker cover 13. It is also conceivable here for the bulkhead wall 22 according to FIG. 3 not to be an integral part of the cover head 13 but instead to be attached separately to the cylinder head 1. Thus, the rocker cover 13 can be removed only by first pulling it away from the camshaft 3 in the direction of arrow 26, whereas the rocker cover 13 according to FIGS. 1 and 2 can also be removed in the vertical direction. If the part of the bulkhead wall 22 beneath the camshaft 3 is designed as a separate part, then vertical lifting of the rocker cover 13 is also possible with an embodiment according to FIG. 3. At the same time, the arrow 26 here indicates the direction of flow of the blow-by gases drawn in from the crankcase. The adjustment mechanism 19 provided for adjustment of the camshaft 3 is situated in the valve space 11 according to FIG. 3 and not in the oil separation space 12 as in FIGS. 1 and 2.

According to FIG. 2, a section of a bulkhead wall situated above the camshaft 3 between the valve space 11 and the oil separation space 12 is formed by the rocker cover 13, whereas according to FIG. 1, a part of the upper section 20 of the camshaft bearing mechanism 2 is provided.

According to FIG. 4, a multichannel device 27 having an inlet channel 10 connected coaxially to the hollow space 5 of the camshaft 3 is connected on the end axially of the camshaft 3, forming an axial gap 9 so that blow-by gases from which the oil has been removed can be discharged from the camshaft 3 through this channel. The multichannel device 27 here is designed so that it introduces separated oil into an oil collecting space 12. The multichannel device 27 is in sealing contact with the camshaft 3 at one end by extending around the camshaft 3. As also shown in FIG. 4, the multichannel device 27 has an outlet channel through which purified blow-by gases are discharged to the outside, i.e., out of the rocker cover 13. In addition, the multichannel device 27 also has an oil return channel 29 which is connected to the oil sump 12.

Furthermore, the multichannel device 27 includes an immersion pipe 28 that forms the outlet channel, whereby the immersion pipe 28 is connected at one end to the multichannel device 27 and at the other end to the rocker cover 13. The immersion pipe 28 is inserted into the rocker cover 13 and is connected to it tightly via another gasket 16'.

All the features described in the description and in the following claims may be essential to the invention either individually or in any combination.

The invention claimed is:

1. A cylinder head (1) of an internal combustion engine, comprising a camshaft bearing mechanism (2) arranged on the cylinder head (1), a hollow camshaft (3) that is rotatably mounted in the camshaft bearing mechanism (2) and forms an outlet for blow-by gases laden with oil droplets out of the crankcase and is designed as an oil droplet separator for separation of the oil content out of these gases, whereby the camshaft (3) passes through a valve space (11) containing the camshaft bearing mechanism (2), whereby a rocker cover (13) or a multichannel device (27) is connected axially at at least one end to the camshaft (3) forming an axial gap (9), each having a channel (10) connected coaxially to the hollow space (5) of the camshaft (3) through which blow-by gases from which the oil has been removed can be discharged from the camshaft (3), whereby the rocker cover (13) or the multichannel device (27) is designed so that it either forms an oil collecting space (12) that is sealed with respect to the valve space (11) or it introduces separated oil into such an oil collecting space (12).

2. The cylinder head according to claim 1, comprising the features the oil separation space (12) has an oil sump (14) situated in the cylinder head (1), the oil sump (14) has a drain valve (15) and/or a drain barrier.

3. The cylinder head according to claim 1, wherein the axial gap (9) between the camshaft (3) and the rocker cover (13) is designed so that during operation of the internal combustion engine, oil separated in the camshaft (3) designed as an oil separator can escape into the oil separation space (12).

4. The cylinder head according to claim 1, wherein the rocker cover (13) is in sealing contact with the cylinder head at one end and with the camshaft (3) or the camshaft bearing mechanism (2) at the other end.

5. The cylinder head according to claim 1, wherein the camshaft (3) has an adjusting device (19) for aligning the camshaft (3), arranged in the oil separation space (12) or in the valve space (11).

6. The cylinder head according to claim 1, wherein a seal (18) which is in contact with the camshaft (3) and seals the valve space (11) with respect to the oil separation space (12) is provided on the rocker cover (13).

7. The cylinder head according to claim 1, wherein the rocker cover (13) is made of plastic and has a metallic insert (23) in the area of the seal (18).

8. The cylinder head according to claim 1, wherein the multichannel device (27) is in sealing contact with the camshaft (3) at one end.

9. The cylinder head according to claim 1, wherein the multichannel device (27) has an inlet channel that is connected to the hollow space (5) of the camshaft (3) and has an outlet channel through which blow-by gases from which the oil has been removed are discharged and has an oil return channel (29) that is connected to or forms the oil sump (14).

10. The cylinder head according to claim 9, wherein the multichannel device (27) comprises an immersion pipe (28) which forms the outlet channel, whereby the immersion pipe (28) is connected at one end to the multichannel device (27) and at the other end to the rocker cover (13).

* * * * *